US005418111A

United States Patent [19]

Naruse et al.

[11] Patent Number: 5,418,111

[45] Date of Patent: May 23, 1995

[54] COLOR DIFFUSION TRANSFER PHOTOGRAPHIC MATERIAL WITH SULFAMOYL PHENYL

[75] Inventors: Hideaki Naruse; Masaaki Tsukase, both of Kanagawa, Japan

[73] Assignee: Fuji Photo Film Co., Ltd., Kanagawa, Japan

[21] Appl. No.: 233,701

[22] Filed: Apr. 26, 1994

[30] Foreign Application Priority Data

Apr. 26, 1993 [JP] Japan ..... 5-099458

[51] Int. Cl.[6] ..... G03C 8/10; G03C 8/14

[52] U.S. Cl. ..... 430/218; 430/222; 430/223; 430/487

[58] Field of Search ..... 430/218, 222, 223, 203, 430/216, 487

[56] References Cited

U.S. PATENT DOCUMENTS 4,358,532 11/1982 Koyama et al. ..... 430/223
4,560,645 12/1985 Toriuchi et al. ..... 430/223
4,590,154 5/1986 Hiria et al. ..... 430/218

FOREIGN PATENT DOCUMENTS 0160313 11/1985 European Pat. Off. .
2081466 2/1982 United Kingdom .

*Primary Examiner*—Richard L. Schilling
*Attorney, Agent, or Firm*—Sughrue, Mion, Zinn, Macpeak & Seas

[57] ABSTRACT

Disclosed is a color diffusion transfer photographic material improved in transfer density (Dmax) and treating temperature dependency thereof on color diffusion transfer, comprising a color diffusion transfer light-sensitive element containing at least one compound represented by the following formula (I) and an alkali treating composition:

(I)

wherein X represents an alkyl group, a cycloalkyl group, an aralkyl group, an alkenyl group, an aryl group, an alkoxy group, an aryloxyl group, an acylamino group, a sulfonylamino group, a ureido group, an alkylthio group, an arylthio group, an alkoxycarbonyl group, a carbamoyl group, a sulfamoyl group, a sulfonyl group, an acyl group, a urethane group, an amino group, a sulfamoylamino groups, a cyano group, a hydroxyl group, a phosphonic acid ester group or a heterocyclic group; n represents an integer of 1 to 5; Xs may be the same or different, when n is 2, 3, 4 or 5; two Xs may be combined with each other to form a saturated ring or an unsaturated ring, when n is 2, 3, 4 or 5; and the substituents may further be substituted by other substituents.

3 Claims, No Drawings

COLOR DIFFUSION TRANSFER PHOTOGRAPHIC MATERIAL WITH SULFAMOYL PHENYL

FIELD OF THE INVENTION

The present invention relates to a color diffusion transfer photographic material using an alkali treating composition, and more particularly to a photographic material increased in transfer density and remarkably improved in treating temperature dependency of transfer density.

BACKGROUND OF THE INVENTION

Color diffusion transfer photography method using azo dye image forming substances which give azo dyes different from image forming compounds themselves in diffusibility as a result of development under basic conditions has hitherto been well known. As dye releasing compounds, the compounds described in U.S. Pat. No. 3,928,312 are known.

However, the dye releasing efficiency of these dye releasing compounds is not always high, so that the compounds have the problem that the transfer density is not sufficiently obtained.

On the other hand, conventional color diffusion transfer film units are used for indoor or outdoor picture taking in many cases, and processed through a wide temperature range. Hence, the high treating temperature dependency of transfer density introduces a serious problem.

These tendencies are particularly noticeable in alkali treatment at low temperatures. Also in this sense, a technique for improving the transfer density and the treating temperature dependency of transfer density has been desired.

Further, as a means for improving the transfer density with additives, a method is described in JP-B-4-13701 (the term "JP-B" as used herein means an "examined Japanese patent publication") in which a sulfonamide compound is added as a methanol solution to a layer containing a dye providing substance, followed by processing at a high temperature in a dried film system.

However, addition of the compound disclosed in the above-described patent did not show improvements in transfer density and treating temperature dependency.

SUMMARY OF THE INVENTION

It is therefore an object of the present invention to provide a color diffusion transfer photographic material increased in transfer density and remarkably improved in treating temperature dependency of transfer density.

This and other objects of the present invention can be attained by (1) a color diffusion transfer photographic material comprising a color diffusion transfer light-sensitive element containing at least one of compounds represented by the following formula (I) and an alkali treating composition:

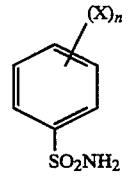

(I)

wherein X represents a substituent selected from the group consisting of an alkyl group, a cycloalkyl group, an aralkyl group, an alkenyl group, an aryl group, an alkoxy group, an aryloxy group, an acylamino group, a sulfonylamino group, a ureido group, an alkylthio group, an arylthio group, an alkoxycarbonyl group, a carbamoyl group, a sulfamoyl group, a sulfonyl group, an acyl group, a urethane group, an amino group, a sulfamoylamino group, a cyano group, a hydroxyl group, a phosphonic acid ester group and a heterocyclic group; n represents an integer of 1 to 5; the substituents represented by X are the same or different, when n is 2, 3, 4 or 5; two substituents represented by X may be combined with each other to form a saturated ring or an unsaturated ring, when n is 2, 3,4 or 5; and the substituents represented by X may further be substituted by substituents represented by X.

More preferably, this and other objects of the present invention can be attained by ( 2 ) the color diffusion transfer photographic material described in (1) mentioned above comprising (a) a transparent support and a light-sensitive sheet formed thereon comprising an image receiving layer, a white reflective layer, a shading layer and at least one of silver halide emulsion layers combined with at least one of dye image forming compounds (also referred to as a "dye image forming substance"), (b) a transparent support and a transparent cover sheet formed thereon comprising at least a neutralization layer and a neutralization timing layer, and (c) the shading alkali treating composition described in (1) mentioned above developed between the above-described light-sensitive sheet and the above-described transparent cover sheet; or (3) the color diffusion transfer photographic material described in (1) mentioned above comprising (a) a support and an image receiving sheet formed thereon comprising a neutralization layer, a neutralization timing layer, an image receiving layer and a separation layer in this order, (b) a support and a light-sensitive sheet formed thereon comprising at least one of silver halide emulsion layers combined with at least one of dye image forming compounds, and (c) the alkali treating composition described in (1) mentioned above developed between the above-described image receiving sheet and the above-described light-sensitive sheet.

DETAILED DESCRIPTION OF THE INVENTION

Formula (I) are hereinafter described in detail.

X represents an alkyl group (having from 1 to 30 carbon atoms, for example, methyl, t-octyl, dodecyl, 2-hexyldecyl, methoxydecyl), a cycloalkyl group (for example, cyclopentyl, cyclohexyl), an aralkyl group (for example, benzyl, 2-phenetyl), an alkenyl group (for example, vinyl, allyl, crotyl), an aryl group (for example, phenyl, naphthyl, 4-octyloxyphenyl, 3-hexadecylphenyl), an alkoxy group (having from 1 to 30 carbon atoms, for example, methoxy, 2-ethylhexyloxy, 2-dodecyloxyethoxy), an aryloxy group (for example, phenoxy, 4-t-octylphenoxy), an acylamino group (for example, acetamido, N-ethyldodecaneamido, 2-n-heptylundecaneamido, 4-t-butylbenzamido, 2-(2,4-di-t-amylphenoxy)butaneamido), a sulfonylamino group (for example, ethanesulfonamido, 2-octyloxy-5-t-octylbenzenesulfonamido, hexadecylsulfonamido), a ureido group (for example, 3-hexadecylureido, 3,3-dioctylureido), an alkylthio group (for example, ethylthio, dodecylthio), an arylthio group (for example, phenylthio, 4-ethoxyphenylthio), an alkoxycarbonyl group (for example, ethoxycarbonyl, hexadecyloxycarbonyl, 2-hexyldecyloxycarbonyl), a carbamoyl group (for example, dimethylcarbamoyl, 3-phenoxypropylcarbamoyl, dioctylcarbamoyl), a sulfamoyl group (for example, dimethylsulfamoyl, morpholinosulfonyl, dioctylsulfamoyl, hexadecylsulfamoyl), an acyl group (for example, propionyl, benzoyl), a sulfonyl group (for example, methanesulfonyl, dodecylsulfonyl), a urethane group (for example, hexadecylurethane, 2-hexyldecylurethane), an amino group (for example, dioctylamino, N-ethyl-N-dodecylamino, 4-methoxyanilino), a sulfamoylamino group (for example, 3,3-dioctylaminosulfamoyl, butylaminosulfamoyl), a heterocyclic group (for example, α-pyridyl, 2-furfuryl), a cyano group, a hydroxyl group, or a phosphonic acid ester group (for example, dicyclohexylphosphonic acid, di-n-octylphosphonic acid ester).

These substituents represented by X may be further substituted by substituents represented by X.

When n is 2, 3, 4 or 5 in formula (I), examples of saturated or unsaturated rings each of which is formed by combination of two substituents represented by X with each other together with the benzene ring in formula (I) include a 5,6,7,8-tetrahydronaphthalene ring, a naphthalene ring, an anthracene ring, an indane ring, an indene ring, an acenaphthene ring, a quinoline ring, a benzothiophene ring, an isobenzofuran ring, an indole ring, a 3H-indole ring, an indazole ring, a chroman ring, an indoline ring, a benzothiazole ring, a benzimidazole ring, a benzoxazole ring and a benzotriazole ring. The saturated or unsaturated rings formed together with the benzene ring in formula (I) may be substituted by the substituents represented by X.

The compounds represented by formula (I) are preferably nondiffusing compounds. The nondiffusing compound means a compound containing a group for giving an enough high molecular weight to immobilize a molecule in a layer to which the compound has been added. Usually, an alkyl group having from 8 to 30 carbon atoms, preferably from 10 to 22 carbon atoms, or an aryl group containing a substituent having from 4 to 20 carbon atoms is employed, and a plurality of the nondiffusing groups may be contained in the compound.

The compounds represented by formula (I) may combine with each other at the substituents represented by X through a divalent or more valent group to form a dimer or a polymer.

X is preferably an alkyl group having from 10 to 22 carbon atoms, an alkoxy group having from 10 to 22 carbon atoms, an alkoxycarbonyl group having from 10 to 30 carbon atoms, an-acylamino group having from 10 to 30 carbon atom, a urethane group having from 10 to 30 carbon atoms or an amino group, which may be substituted. X is more preferably an acylamino group, a urethane group or an amino group, which may be substituted.

Examples of the compounds represented by formula (I) which are used in the present invention are shown below, but they are not limited thereto:

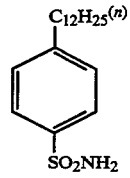

I-1

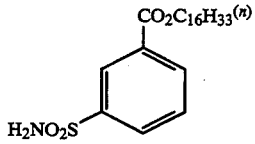

I-2

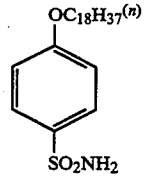

I-3

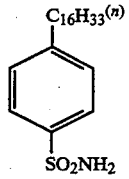

I-4

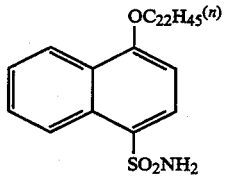

I-5

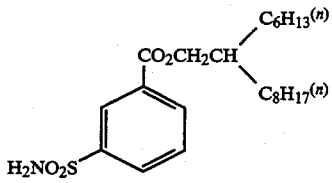

I-6

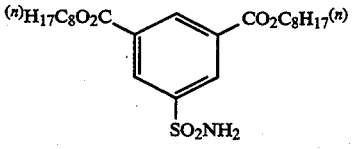

I-7

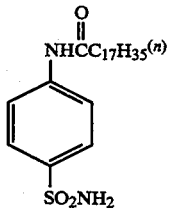

I-8

-continued
I-9
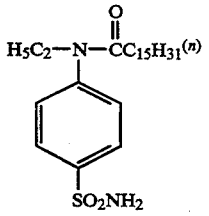
I-10
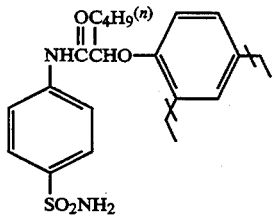
I-11
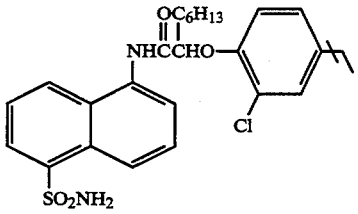
I-12
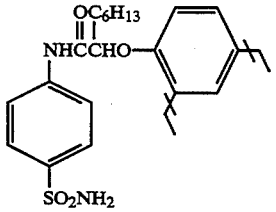
I-13
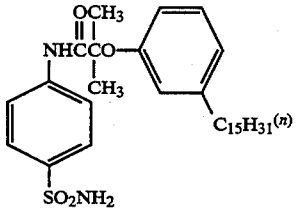
I-14
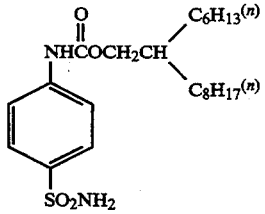
I-15
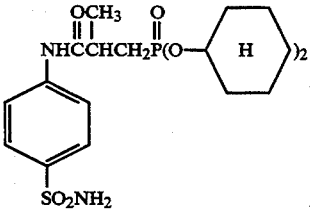
-continued
I-16
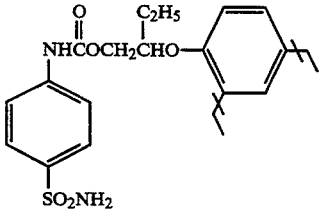
I-17
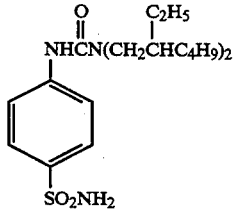
I-18
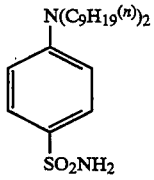
I-19
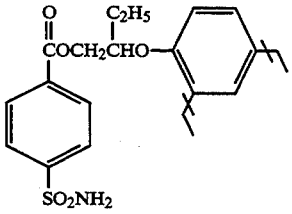
I-20
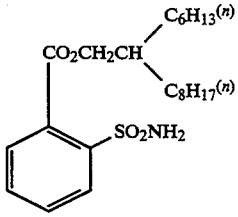
I-21
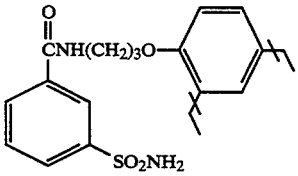
I-22
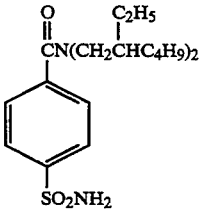
I-23
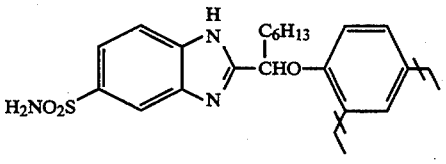

-continued
I-24
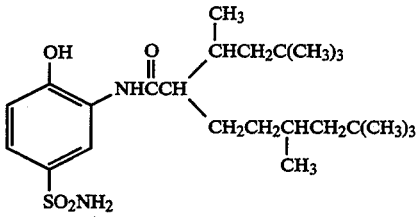
I-25
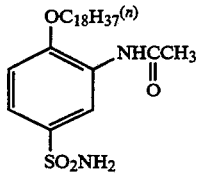
I-26
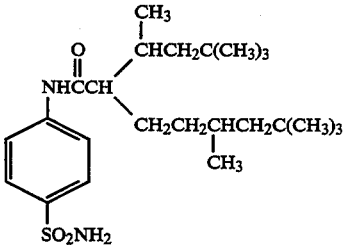
I-27
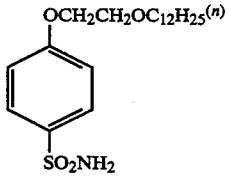
I-28
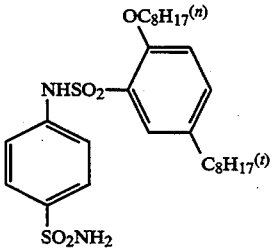
I-29
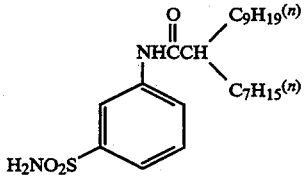
I-30
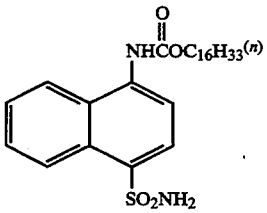
-continued
I-31
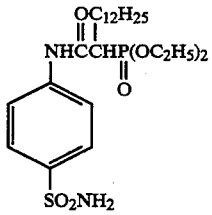
I-32
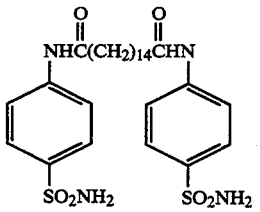
I-33
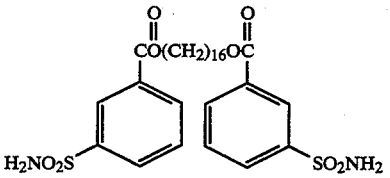
I-34
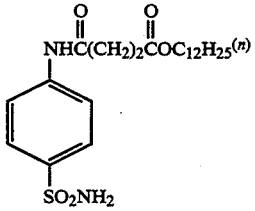
I-35
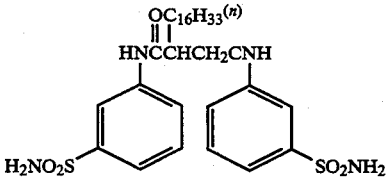
I-36
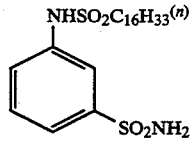
I-37
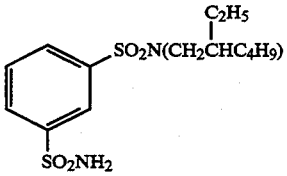
I-38
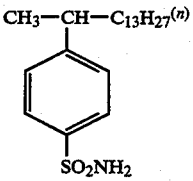

-continued

I-39

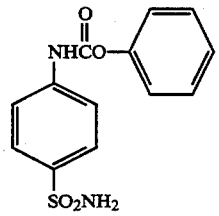

I-40

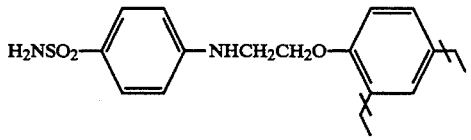

In the above-described compounds, it is preferred that a hydrogen atom is bound at least one of both the ortho positions to a sulfamoyl group (including the peri-positions for naphthalene), and more preferably, hydrogen atoms are bound at both the ortho positions.

Methods for synthesizing the compounds used in the present invention will be illustrated below.

SYNTHESIS EXAMPLE (1)

SYNTHESIS OF COMPOUND I-1

Twenty-one grams of n-dodecylbenzene was added dropwise to 20 ml of chlorosulfonic acid at a temperature of 20° C. or lower over a 30-minute period under cooling with water. After termination of the addition, stirring was continued for 2 hours, and the reaction mixture was poured into 300 g of ice water with stirring. An oily component separated was extracted with 300 ml of ethyl acetate. After separation of the aqueous layer, the ethyl acetate layer was added dropwise to 1 liter of a saturated ammonia/acetonitrile solution at a temperature of 0° C. or lower over a 30-minute period with stirring. After termination of the addition, the reaction mixture was stirred for 1 hour under cooling with ice, and further for 1 hour at a room temperature. The reaction mixture was extracted with ethyl acetate, and then the ethyl acetate layer was concentrated to dryness under reduced pressure to obtain precipitated crystals. The crystals were purified by flash column chromatography (silica gel/chloroform solvent) to obtain Compound I-1.

The yield was 17 g (61%), and the melting point of Compound I-1 was 97° to 98° C.

SYNTHESIS EXAMPLE (2).

SYNTHESIS OF COMPOUND I-2

One hundred milliliters of N,N-dimethylacetamide was added dropwise to a suspension of 52.6 g of 3-chlorosulfonylbenzoyl chloride and 48 g of 1-hexadecanol in 500 ml of acetonitrile at a room temperature for 15 minutes with stirring. After termination of the addition, the mixture was further stirred for two hours. Precipitated crystals were collected by filtration and washed with 200 ml of acetonitrile. The yield was 68 g (78%).

Sixty grams of the crystals was added little by little to 1 liter of an acetonitrile solution saturated with ammonia at a temperature of 0° C. or lower over a 30-minute period with stirring. After termination of the addition, stirring was further continued for 2 hours, and 1 liter of water was added to the reaction mixture to precipitate crystals. The crystals were collected by filtration and washed with water. The fully dried crystals were dissolved in chloroform, and purified by flash column chromatography (silica gel/chloroform) to obtain Compound I-2.

The yield was 44 g (57%), and the melting point of Compound I-2 was 81° to 82° C.

SYNTHESIS EXAMPLE (3)

SYNTHESIS OF COMPOUND I-12

To a solution containing 17.2 g of sulfanilamide and 10 ml of pyridine in 100 ml of N,N-dimethylacetamide, 36.6 g of 2-(2,4-di-t-amylphenoxy)hexanoyl chloride was added dropwise at a temperature of 5° C. or lower for about 30 minutes with stirring. After termination of the addition, stirring was continued under cooling with ice for 1 hour and further under cooling with water for 1 hour. When 300 ml of water was poured into the reaction mixture, oily matter of high viscosity was deposited. The supernatant was removed by decantation, and the oily matter was dissolved in 200 ml of ethyl acetate. Then, the solution was dried overnight over anhydrous magnesium sulfate. Magnesium sulfate was removed by filtration, and ethyl acetate was concentrated to dryness under reduced pressure. The residue was dissolved in 100 ml of methanol, and 30 ml of water was added at a room temperature with stirring. To this suspension, 0.1 g of crystals of Compound I-12 was added to precipitate crystals. The crystals were collected by filtration and washed with 100 ml of water. The crude crystals were sufficiently dried and recrystallized from 300 ml of n-hexane and 50 ml of ethyl acetate to obtain Compound I-12.

The yield was 21 g (42%), and the melting point of Compound I-12 was 120° C.

SYNTHESIS EXAMPLE (4)

SYNTHESIS OF COMPOUND I-16

Forty-seven grams of phenyl chloroformate was added dropwise to a solution of 51.6 g of sulfanilamide and 30 ml of pyridine in 300 ml of N,N-dimethylacetamide over a 30-minute period maintaining the internal temperature at 0° to 5° C. After termination of the addition, stirring was continued at the above temperature for 1 hour, and further under cooling with ice for 1 hour. When 600 ml of water was poured into the reaction mixture, white crystals separated out. After stirring as such for 1 hour, the crystals was collected by filtration, washed with water, and dried to obtain Compound I-42.

I-42: yield: 82 g (94%)

Twenty grams of Compound I-42 and 83 g or Fine Oxocol-1600 (manufactured by Nissan Chemical Industries, Ltd.) were stirred at an internal temperature of 150° to 160° C. for 2 hours, and then at an internal temperature of from 200° to 220° C. for 6 hours. The reaction mixture was allowed to stand overnight at a room temperature, and 200 ml of n-hexane was added thereto to precipitate crystals. The crystals were collected by filtration and washed with 100 ml of n-hexane. The crystals were recrystallized from 300 ml of n-hexane and 60 ml of ethyl acetate to obtain Compound I-16.

The yield was 15 g (52%), and the melting point of Compound I-16 was 111° to 112° C.

The compounds represented by formula (I) in the present invention are preferably used in an amount of from 0.1 to 500 mol %, more preferably in an amount of from 20 to 300 mol %, and most preferably in an amount of from 50 to 200 mol %, per mol of dye image forming compounds.

It is preferable that the compounds represented by formula (I) in the present invention are added to the same layers to which the dye image forming compounds are added.

In the present invention, various known methods can be utilized for adding the above-described dye image forming compounds to hydrophilic colloidal layers. Usually, they can be added by the oil-in-water dispersion method know as the oil protect method. Namely, in this method, the dye image forming compounds are dissolved in a high boiling solvent (e.g., phosphate, phthalate) and a low boiling auxiliary solvent, and then the resulting solution is dispersed in an aqueous solution of gelatin supplemented with a surface active agent. Alternatively, water or an aqueous solution of gelatin may be added to a solution of the dye image forming compounds containing a surface active agent to form an oil-in-water dispersion, accompanied by phase inversion. In order to remove the low boiling organic solvent from the resulting dispersion, distillation, water washing with noodle or ultrafiltration is preferably used.

As dispersion media for such dye image forming compounds, high boiling organic solvents having a permittivity of from 2 to 20 (at 25° C.) and a refractive index of from 1.4 to 1.7 and/or water-insoluble polymers described in U.S. Pat. No. 4,857,449, columns 7 to 15, and PCT International Publication No. W088/00723, pages 12 to 30, can be preferably used. In the present invention, the weight ratio of the dispersion media to the dye image forming compounds is preferably from 0.1 to 10, and more preferably from 0.3 to 3.

Then, color diffusion transfer processes used in the present invention are described.

In a typical form of film units used in the color diffusion transfer processes, an image receiving element and a light-sensitive element are laminated on one transparent support, and the light-sensitive element is not necessary to be separated from the image receiving element after completion of a transferred image. More specifically, the image receiving element comprises at least one mordant layer. A preferred embodiment of the light-sensitive element is formed by combining a combination of a blue-sensitive emulsion layer, a green-sensitive emulsion layer and a red-sensitive layer; a combination of a green-sensitive emulsion layer, a red-sensitive emulsion layer and an infrared light-sensitive emulsion layer; or a combination of a blue-sensitive emulsion layer, a red-sensitive emulsion layer and an infrared light-sensitive layer; with combinations of the respective emulsion layers described above with a yellow dye providing substance, a magenta dye providing substance and a cyan dye providing substance, respectively, wherein the "infrared light-sensitive emulsion layer" means an emulsion layer sensitive to light having a wavelength of 700 nm or more, particularly 740 nm or more. A white reflective layer containing a solid pigment such as titanium oxide is provided between the mordant layer and the light-sensitive layer or between the mordant layer and the layer containing the dye providing substance so as to be able to view the transferred image through the transparent support.

In order to make it possible to complete processing in daylight, a shading layer may be further provided between the white reflective layer and the light-sensitive layer. In order to allow all or a part of the light-sensitive element to be separated from the image receiving element if desired, a separation layer may be formed in an appropriate portion (such embodiments are described, for example, in JP-A-56-67840 (the term "JP-A" as used herein means an "unexamined published Japanese patent application") and Canadian Patent No. 674,082).

As another separable embodiment of a lamination type, JP-A-63-226649 discloses a color diffusion transfer photographic film unit comprising a white support and a light-sensitive element formed thereon comprising (a) a layer having a neutralization function, (b) a dye image receiving layer, (c) a separation layer and (d) at least one silver halide emulsion layer combined with a dye image forming substance in this order; an alkali treating composition containing a shading agent; and a transparent cover sheet; which further comprising a layer having a shading function on the side opposite to a side on which the treating composition of the emulsion layer is developed.

Further, in another form in which separation is unnecessary, the above-described light-sensitive element is formed on a transparent support, a white reflective layer is formed thereon, and an image receiving layer is further laminated thereon. An embodiment in which an image receiving element, a white reflective layer, a separation layer and a light-sensitive element are laminated on the same support and the light-sensitive element is intentionally separated from the image receiving element is described in U.S. Pat. No. 3,730,718.

On the other hand, typical forms in which a light-sensitive element and an image receiving element are separately formed on two supports, respectively, are roughly divided into two forms. One is a separation type and the other is a separation-unnecessary type. These types are illustrated in detail. In a preferred embodiment of the separation type film unit, at least one image receiving layer is formed on a support, and a light-sensitive element is formed on a support having a shading layer. Before termination of exposure, a coated surface of the light-sensitive layer does not face to a coated surface of a mordant layer. After termination of exposure (for example, during processing), however, the coated surface of the light-sensitive layer is turned over to be superposed on the coated surface of the image receiving layer. After completion of a transferred image on the mordant layer, the light-sensitive element is rapidly separated from the image receiving element.

Further, in a preferred embodiment of the separation-unnecessary type film unit, at least one mordant layer is formed on a transparent support, and a light-sensitive element is formed on a support having a transparent or shading layer. A coated surface of the light-sensitive layer is superposed face to face with a coated surface of the mordant layer.

A pressure-rupturable container containing an alkali treating solution (a treating element) may be combined with the above-described embodiments. In the separation-unnecessary type film unit in which the image receiving element and the light-sensitive element are laminated on one support, this treating element is preferably arranged between the light-sensitive element and a cover sheet superposed thereon among others. In the form in which the light-sensitive element and the image receiving element are separately formed on two supports, respectively, the treating element is preferably arranged between the light-sensitive element and the image receiving element upon processing at latest. The treating elements preferably contain shading agents (such as carbon black and dyes which vary in color according to the pH) and/or white pigments (such as titanium oxide) depending on the form of film units. Further, in the film unit of the color diffusion transfer system, a neutralization timing mechanism comprising a neutralization layer and a neutralization timing layer in combination is preferably incorporated into a cover sheet, an image receiving element or a light-sensitive layer.

The respective constituent elements included in the present invention are hereinafter described.

I. Light-sensitive Sheet

A) Support

For the support of the light-sensitive sheet used in the present invention, any support may be used as long as it is a smooth transparent support of the type commonly used in photographic materials. The support may be formed of cellulose acetate, polystyrene, polyethylene terephthalate or polycarbonate, and preferably provided with an undercoat layer. It is preferred that the support contain a dye or a pigment such as titanium oxide in slight amounts to prevent light piping.

The thickness of the support is from 50 to 350 μm, preferably from 70 to 210 μm, and more preferably from 80 to 150 μm.

A curl balancing layer or an oxygen shielding layer described in JP-A-56-78833 may be formed on the back side of the support if desired.

B) Image Receiving Layer

The image receiving layer used in the present invention contains a mordant in a hydrophilic colloid. The layer may have either a monolayer structure or a multilayer structure in which mordants different from one another in mordant ability are contained. This is described in JP-A-61-252551.

The polymer mordants are preferably used as a mordant. Examples of the polymer mordants include polymers containing a secondary or tertiary amino group, polymers containing a nitrogen-containing heterocyclic moiety or polymers containing a quaternary cation, each preferably having a molecular weight of 5,000 or more, and more preferably 10,000 or more.

The amount of the mordants applied is generally from 0.5 to 10 g/m$^2$, preferably from 1.0 to 5.0 g/m$^2$, and more preferably from 2.0 to 4.0 g/m$^2$.

Examples of the hydrophilic colloids used in the image receiving layer include gelatin, polyvinyl alcohol, polyacrylamide and polyvinylpyrrolidone. Gelatin is particularly preferred among them.

Antifading agents described in JP-A-62-30620, JP-A-62-30621 and JP-A-62-215272 can be incorporated into the image receiving layer.

C) White Reflective Layer

The white reflective layer forming the white background of a color image usually comprises a white pigment and a hydrophilic binder. Examples of the white pigments used in the white reflective layer include barium sulfate, zinc oxide, barium stearate, silver flakes, silicates, alumina, zirconium oxide, sodium zirconium sulfate, kaolin, mica and titanium dioxide. In addition, non-film forming polymer particles formed of polystyrene or the like may be used. These may be used alone or in combination within the range giving a desired reflectance.

As the white pigment, titanium dioxide is more preferred.

The whiteness of the white reflective layer varies depending on the kind of pigment, the pigment-binder mixture ratio and the amount of the pigment applied. It is, however, desirable that the light reflectance is 70% or more. In general, the whiteness increases with an increase in the amount of the pigment applied. However, when the image forming dye diffuses through this layer, the diffusion of the dye is resisted by the pigment. It is therefore desirable to apply the pigment in suitable amounts.

It is preferred that titanium dioxide is applied in an amount of from 5 to 40 g/m$^2$, preferably from 10 to 25 g/m$^2$, to give a white reflective layer having a light reflectance of from 78 to 85% at a wavelength of 540 mm.

Titanium dioxide can be selected from various commercial products. In particular, rutile type titanium dioxide is preferably used among others. Many of the commercial products are surface treated with alumina, silica, zinc oxide or the like. In order to obtain a high reflectance, it is desirable that titanium dioxide has at least 5% of the surface treating material. Commercially available titanium dioxide includes, for example, products described in *Research Disclosure*, No. 15162, as well as Ti-pure R931 (Du Pont).

The binders suitable for the white reflective layer include alkali-permeable high polymer matrixes, for example, gelatin, polyvinyl alcohol and cellulose derivatives such as hydroxyethyl cellulose and carboxymethyl cellulose. Of these, gelatin is more preferred.

The white pigment-gelatin ratio is 1/1 to 20/1 (by weight), and preferably 5/1 to 10/1 (by weight).

It is preferred that antifading agents as described in JP-A-62-30620 and JP-A-62-30621 are incorporated into the white reflective layer.

D) Shading Layer

The shading layer comprising a shading agent and a hydrophilic binder is provided between the white reflective layer and the light-sensitive layer.

As the shading agent, any material may be used as long as it performs a shading function. In particular, carbon black is preferably used. Decomposable dyes described in U.S. Pat. No. 4,615,966 may also be used.

As the binder for applying the shading agent, any material may be used as long as it can disperse carbon black. Gelatin is preferably used.

Carbon black materials which can be used include carbon black produced by any methods such as the channel method, the thermal method and the furnace method, for example, as described in Donnel Voet, *Carbon Black*, Marcel Dekker Inc. (1976). There is no particular limitation on the particle size of carbon black, but the particle size is preferably from 90 to 1,800 A. The amount of a black dye added as the shading agent may be adjusted depending on the sensitivity of the photographic material to be shaded. The optical density is preferably adjusted to about 5 to 10.

E) Light-sensitive Layer

In the present invention, the light-sensitive layer comprising a silver halide emulsion layer combined with a dye image forming substance is formed on the above-described shading layer. The constituent elements thereof are described below.

(1) Dye Image Forming Substance

The dye image forming substances used in the present invention is non-diffusible compounds releasing diffusible dyes (or dye precursors) with respect to silver development or compounds whose diffusibility varies, which are described in *The Theory of the Photographic*

*Process*, the fourth edition. These compounds are all represented by the following formula (II):

$$(DYE\text{-}Y)_n\text{—}Z \qquad (II)$$

wherein DYE represents a dye group, a dye group temporarily shortened in wavelength or a dye precursor group; Y represents a bonding group or connecting group; Z represents a group which produces the difference in diffusibility of the compound represented by $(DYE\text{-}Y)_n$—Z corresponding or reversely corresponding to a light-sensitive silver salt having an imagewise latent image, or a group which releases DYE to produce the difference in diffusibility between released DYE and $(DYE\text{-}Y)_n$—Z; n represents 1 or 2; and two (DYE-Y)s are the same or different, when n is 2.

Based on the function of Z, these compounds are roughly divided into negative type compounds which become diffusible in silver-developed portions and positive type compounds which become diffusible in undeveloped portions.

Examples of the negative type Z components include components which are oxidized as a result of development and cleaved to release diffusible dyes.

Example of the Z components are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Of the Z components of the negative type dye releasing redox compounds, particularly preferred groups include N-substituted sulfamoyl groups (wherein N-substituted groups are groups derived from aromatic hydrocarbon rings or hetero rings). Typical examples of the Z groups are shown below, but they are not limited thereto.

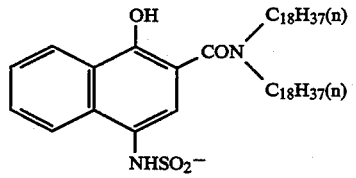

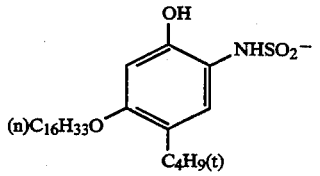

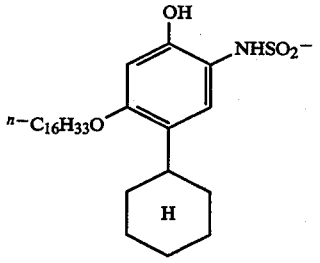

-continued

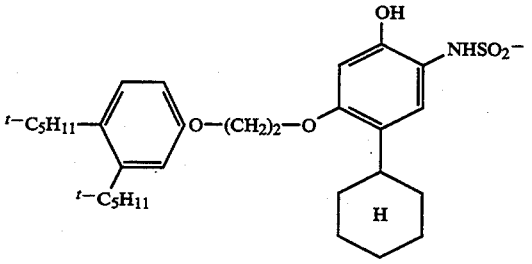

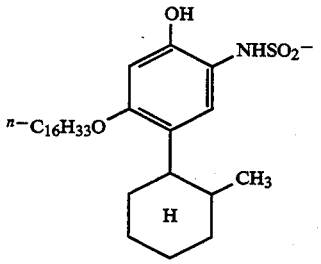

The positive type compounds are described in *Angew. Chem. Inst. Ed. Engl.*, 22, 191 (1982).

Examples thereof include compounds (i.e. dye developing agents) which are at first diffusible under alkaline conditions, but oxidized by development to become non-diffusible. Typical Z components effective for the compounds of this type are disclosed in U.S. Pat. No. 2,983,606.

Further, the positive type compounds include compounds of another type which release diffusible dyes by self-cyclization, etc. under alkaline conditions, but substantially cease to release the dyes upon oxidation by development. Examples of Z components having such a function are described in U.S. Pat. No. 3,980,479, JP-A-53-69033, JP-A-54-130927, U.S. Pat. Nos. 3,421,964 and 4,199,355.

Furthermore, the positive type compounds include compounds of a further type which do not themselves release dyes, but release the dyes upon reduction. The compounds of this type are used in combination with electron donors, and can release the diffusible dyes imagewise by reaction with the remainder of the electron donors oxidized imagewise by silver development. Atomic groups having such a function are described, for example, in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,525, JP-A-53-110827, JP-A-54-130927, JP-A-56-164342, Kokai Giho (Journal of Technical Disclosure) 87-6199 and EP-A2-220746.

Examples thereof are enumerated below, but they are not limited thereto.

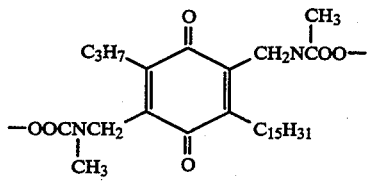

-continued

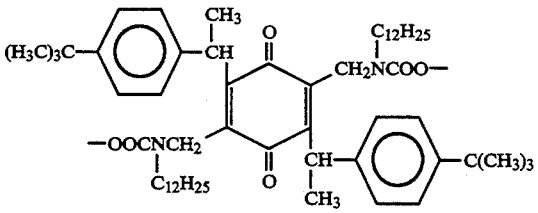

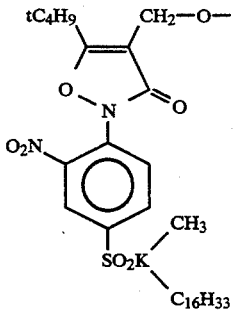

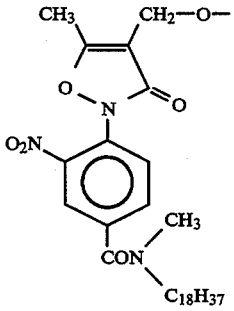

When the compounds of this type are used, they are preferably used in combination with anti-diffusible electron donor compounds (well known as ED compounds) or precursors thereof. Examples of the ED compounds are described, for example, in U.S. Pat. Nos. 4,263,393 and 4,278,750 and JP-A-56-138736.

Moreover, as examples of dye image forming substances of still another type, the following compounds can also be used:

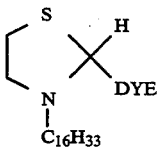

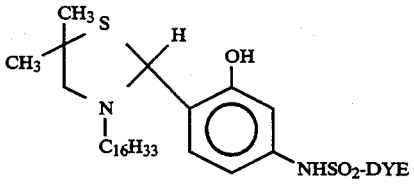

wherein DYE represents a dye or a precursor thereof having the same meaning as defined above.

Details thereof are described in U.S. Pat. Nos. 3,719,489 and 4,098,783.

On the other hand, examples of the dyes represented by DYE of the above-described formula (II) are described in the following literature references:

Examples of yellow dyes:

U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072, *Research Disclosure*, No. 17630 (1978) and ibid., No. 16475 (1977);

Examples of magenta dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134;

Examples of cyan dyes:

U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents (EPC) 53,037 and 53,040, *Research Disclosure*, No. 17630 (1978) and ibid., No. 16475 (1977).

These compounds can be dispersed by the method described in JP-A-62-215272, pages 144 to 146. These dispersions may contain the compounds described in JP-A-62-215272, pages 137 to 144.

(2) Silver Halide Emulsion

The silver halide emulsions used in the present invention may be either negative type emulsions in which latent images are mainly formed on the surfaces of silver halide grains or internal latent image type direct positive emulsions in which latent images are formed inside silver halide grains.

Examples of the internal latent image type direct positive emulsions include so-called "conversion type" emulsions which are prepared utilizing the difference in solubility of silver halides and "core/shell type" emulsions in which at least the light-sensitive sites of inner core grains of silver halides doped with metal ions and/or chemically sensitized are covered with outer shells of silver halides. These are described in, for example, U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662 and 4,395,478, West German Patent 2,728,108, U.S. Pat. No. 4,431,730.

Further, when the internal latent image type direct positive emulsions are used, it is necessary to give surface fogging cores by use of light or nucleating agents after imagewise exposure.

The nucleating agents used for this purpose include hydrazines described in U.S. Pat. Nos. 2,563,785 and 2,588,982; hydrazines and hydrazones described in U.S. Pat. No. 3,227,552; heterocyclic quaternary salt compounds described in British Patent 1,283,835, JP-A-52-69613, U.S. Pat. Nos. 3,615,615, 3,719,494, 3,734,738, 4,094,683 and 4,115,122; sensitizing dyes having substituent groups with nucleating ability in dye molecules described in U.S. Pat. No. 3,718,470; thiourea-bonding type acylhydrazine compounds described in U.S. Pat. Nos. 4,030,925, 4,031,127, 4,245,037, 4,255,511, 4,266,013 and 4,276,364 and British Patent 2,012,443; and acylhydrazine compounds having thioamido rings or heterocyclic groups such as triazole and tetrazole as absorption groups described in U.S. Pat. No. 4,080,270 and 4,278,748 and British Patent 2,011,391B.

In the present invention, color sensitizing dyes are used in combination with these negative type emulsions and internal latent image type direct positive emulsions. Examples thereof are described in JP-A-59-180550, JP-A-60-140335, *Research Disclosure*, No. 17029 (1978), U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, and 4,025,349.

(3) Constitution of Light-sensitive Layer

For reproduction of natural colors by the subtractive color process, a light-sensitive layer is used which comprises in combination the emulsion optically sensitized with the above-described color sensitizing dye and the above-described dye image forming substance for providing a dye having selective spectral absorption within the same wavelength range. The emulsion and the dye image forming substance may be either formed one over the other as different layers, or formed as one layer by mixing them. When the dye image forming substance has absorption in the optical sensitivity region of the emulsion combined therewith in its coated state, it is preferred that they are formed as the different layers. The emulsion layer may comprise a plurality of emulsion layers different in sensitivity, and any layer may be provided between the emulsion layer and the dye image forming substance layer. For example, the dye image density can be raised by providing a layer containing the nucleating development accelerator described in JP-A-60-173541 or a barrier layer described in JP-B-60-15267, or the sensitivity of the light-sensitive elements can be enhanced by providing a reflective layer.

The reflective layer is a layer containing a white pigment and a hydrophilic binder. The white pigment is preferably titanium oxide and the hydrophilic binder is preferably gelatin. The amount of titanium oxide applied is 0.1 to 8 g/m$^2$, and preferably 0.2 to 4 g/m$^2$. Examples of the reflective layers are described in JP-A-60-91354.

In the preferred multilayer structure, a combined unit of blue-sensitive emulsions, a combined unit of green-sensitive emulsions and a combined unit of red-sensitive emulsions are arranged in this order from the exposure side.

Any layer can be provided between the respective emulsion layer units as desired. In particular, an intermediate layer is preferably provided in order to prevent other emulsion layer units from being unfavorably affected by the development effect of a certain emulsion layer.

When a developing agent is used in combination with a non-diffusible dye image forming substance, it is preferred that the intermediate layer contains a non-diffusible reducing agent to prevent the development oxidant from diffusing. Examples of the reducing agents include non-diffusible hydroquinone, sulfonamidophenol and sulfonamidonaphthol. More specifically, they are described in, for example, JP-B-50-21249, JP-B-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393 and 3,700,453, British Patent 557,750, JP-A-57-24941, and JP-A-58-21249. Dispersing methods thereof are described in JP-A-60-238831 and JP-B-60-18978.

When a compound releasing the diffusible dye with silver ions as described in JP-B-55-7576 is used, it is preferred that the intermediate layer contains a compound for capturing the silver ions.

The light-sensitive layers used in the present invention are provided with, for example, irradiation-preventing layers, ultraviolet light absorber layers, protective layers, if desired.

F) Separation Layer

In the present invention, a separation layer can be provided to be separated in any portion of a light-sensitive sheet in a unit after processing as desired. This separation layer must therefore be easily separable after processing. Examples of materials which can be used for this purpose are described in JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-A-45-24075, U.S. Pat. Nos. 3,227,550, 2,759,825, 4,401,746 and 4,366,227. Specific examples thereof include water-soluble or alkali-soluble cellulose derivatives such as hydroxyethyl cellulose, cellulose acetate phthalate, plasticized methyl cellulose, ethyl cellulose, cellulose nitrate and carboxymethyl cellulose. Other examples include various natural polymers such as alginic acid, pectin and gum arabic. Further, various modified gelatin derivatives such as acetylated gelatin and phthalated gelatin can be used. Still other examples include water-soluble synthetic polymers such as polyvinyl alcohol, polyacrylate, polymethyl methacrylate, polybutyl methacrylate and copolymers thereof.

The separation layer may be a single layer or may be composed of a plurality of layers as described in JP-A-59-220727 and JP-A-60-60642.

It is preferred that the color diffusion transfer photographic material of the present invention is allowed to have a neutralization function between a support and a light-sensitive layer, between the support and an image receiving layer, or on a cover sheet.

II. Cover Sheet

G) Support

For the support of the cover sheet used in the present invention, any support may be used as long as it is a smooth transparent support of the type commonly used in photographic materials. The support is formed of cellulose acetate, polystyrene, polyethylene terephthalate or polycarbonate, and preferably provided with an undercoat. It is preferred that the support contains a dye in slight amounts to prevent light piping.

The thickness of the support is from 50 to 350 μm, preferably from 70 to 210 μm, and more preferably from 80 to 150 μm.

H) Layer Having Neutralization Function

The layer having a neutralization function used in the present invention is a layer containing an acidic material in an amount enough to neutralize the alkali incorporated from the processing composition. The layer may have a multilayer structure comprising layers such as a neutralization speed control layer (i.e., a timing layer) and an adhesion-enhancing layer, if desired. Preferred examples of such acidic materials include materials containing an acidic group having a pKa of 9 or less (or a precursor group giving such an acidic group by hydrolysis). More preferably, the acidic materials include higher fatty acids such as oleic acid described in U.S. Pat. No. 2,983,606; polymers of acrylic acid, methacrylic acid or maleic acid, partial esters thereof or acid anhydrides thereof disclosed in U.S. Pat. No. 3,362,819; copolymers of acrylic acid and acrylates disclosed in French Patent 2,290,699; and latex type acidic polymers disclosed in U.S. Pat. No. 4,139,383 and *Research Disclosure*, No. 16102 (1977).

In addition, they also include the acidic materials disclosed in U.S. Pat. No. 4,088,493, JP-A-52-153739, JP-A-53-1023, JP-A-53-4540, JP-A-53-4541 and JP-A-53-4542.

Examples of the acidic polymers include copolymers of maleic anhydride and vinyl monomers such as ethylene, vinyl acetate and methyl vinyl ether, n-butyl ester thereof, copolymers of butyl acrylate and acrylic acid, and cellulose acetate hydrogen phthalate.

The above-described acidic polymers can be mixed with hydrophilic polymers in use. Such polymers include polyacrylamide, polymethylpyrrolidone, polyvinyl alcohol (including partially saponified polyvinyl alcohol), carboxymethyl cellulose, hydroxymethyl cellulose, hydroxyethyl cellulose and polymethyl vinyl ether. Polyvinyl alcohol is preferred among them.

The above-described acidic polymers may be mixed with polymers other than the hydrophilic polymers, for example, cellulose acetate.

The amount of the acidic polymer applied is adjusted according to the amount of the alkali developed on the light-sensitive element. The equivalent ratio of the acidic polymer to the alkali per unit area is preferably from 0.9 to 2.0. If the amount of the acidic polymer is too small, the hue of a transfer dye changes or stains are generated on a white ground portion. If the amount is too large, troubles such as a change in hue and a decrease in light fastness are produced. More preferably, the equivalent ratio thereof is from 1.0 to 1.3. Too large or too small an amount of the hydrophilic polymer to be mixed deteriorates the quality of a photograph. The weight ratio of the hydrophilic polymer to the acidic polymer is from 0.1 to 10, and preferably from 0.3 to 3.0.

For various purposes, additives may be incorporated into the layer having the neutralization function used in the present invention. For example, a hardening agent known in the art can be added to this layer to harden it, and a multivalent hydroxyl compound such as polyethylene glycol, polypropylene glycol or glycerol can be added to this layer to improve the brittleness thereof. In addition, an antioxidant, a fluorescent brightening agent, a development inhibitor or a precursor thereof can also be added as desired.

Useful polymers of the timing layers used in combination with the neutralization layers include polymers reducing alkali permeability such as gelatin, polyvinyl alcohol, partially acetalized products of polyvinyl alcohol, cellulose acetate and partially hydrolyzed polyvinyl acetate; latex polymers elevating the activation energy of alkali permeance which are produced by copolymerizing a small amount of hydrophilic comonomers such as an acrylic acid monomer; and polymers having lactone rings.

Particularly useful polymers used in the timing layers include cellulose acetate disclosed in JP-A-54-136328, U.S. Pat. Nos. 4,267,262, 4,009,030 and 4,029,849; latex polymers produced by copolymerizing a small amount of hydrophilic comonomers such as acrylic acid which are disclosed in JP-A-54-128335, JP-A-56-69629, JP-A-57-6843, U.S. Pat. Nos. 4,056,394, 4,061,496, 4,199,362, 4,250,243, 4,256,827 and 4,268,604; polymers having lactone rings disclosed in U.S. Pat. No. 4,229,516; and other polymers disclosed in JP-A-56-25735, JP-A-56-97346, JP-A-57-6842, EP-A1-31,957, EP-A1-37,724 and EP-A1-48,412.

Besides, polymers can also be used which are described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patent Application Laid-Open Nos. (OLS) 1,622,936 and 2,162,277 and *Research Disclosure*, No. 15162 (1976).

The timing layers using these polymers can be used alone or in a combination of at least two layers.

Further, for example, development inhibitors and/or precursors thereof disclosed in U.S. Pat. No. 4,009,029, West German Patent Laid-Open Nos. (OLS) 2,913,164 and 3,014,672, JP-A-54-155837 and JP-A-55-138745, or hydroquinone precursors disclosed in U.S. Pat. No. 4,201,578, or other useful photographic additives or precursors thereof can be incorporated into the timing layers formed of these polymers.

Furthermore, an auxiliary neutralization layer may be provided as the layer having the neutralization function as described in JP-A-63-168648 and JP-A-63-168649, thereby effectively decreasing a change in transfer density with time after processing.

I) Others

In addition to the layer having the neutralization function, the cover sheet may have auxiliary layers such as a backing layer, a protective layer, a filter dye layer and a dye capture mordant layer.

The backing layer is provided to control curl or to impart a slipping property. A filter dye may be added to this layer.

The protective layer is used mainly to prevent adhesion to a cover sheet back surface and adhesion to the protective layer of the photographic material when the cover sheet is superposed on the photographic material.

The cover sheet can contain a dye to adjust the sensitivity of the light-sensitive layer. A filter dye may be directly added to the support of the cover sheet, the layer having the neutralization function, the backing layer, the protective layer, the dye capture mordant, or a separate layer containing the filter dye may be formed.

III. Alkali Treating Composition

The alkali treating composition used in the present invention is uniformly developed on the light-sensitive elements after exposure thereof, is provided on the back surface of the support or on the side opposite to a treating solution for the light-sensitive layer to make a pair with the shading layer, thereby completely shielding the light-sensitive layer from external light, and concurrently develops the light-sensitive layer with components contained therein. For this purpose, the composition contains an alkali, a thickener, a shading agent and a developing agent, and further contains a development accelerator or a development inhibitor for controlling development, and an antioxidant for preventing the developing agent from deteriorating. The shading agent is necessarily contained in the composition.

The alkali is a compound which can adjust the pH to 12 to 14. Examples thereof include hydroxides of alkaline metals (for example, sodium hydroxide, potassium hydroxide, lithium hydroxide), phosphates of alkaline metals (for example, potassium phosphate), guanidines and hydroxides of quaternary amines (for example, tetramethylammonium hydroxide). Potassium hydroxide and sodium hydroxide are preferred among them.

The thickener is necessary to develop the treating solution uniformly and to keep adhesion between the light-sensitive layer and the cover sheet. For example, polyvinyl alcohol, hydroxyethyl cellulose and alkaline metal salts of carboxymethyl cellulose are used, and hydroxyethyl cellulose and sodium carboxymethyl cellulose are preferably used.

As the shading agent, either a dye or a pigment or a combination thereof can be used as long as it does not produce stains by diffusing to the dye image receiving layer. Typical examples thereof include carbon black.

As the developing agent, any can be used as long as it cross oxidizes the dye image forming substance and does not substantially produce stains when oxidized. Such developing agents may be used alone or in combination, and may be used in the form of precursors. These developing agents may be added to appropriate layers of the light-sensitive elements, or to alkali treating solutions. Examples thereof include aminophenols and pyrazolidinone compounds. Of these, the pyrazolidinone compounds are particularly preferred because less stain is produced.

Examples of such compounds include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone and 1-p-tolyl-4'-methyl-4-hydroxymethyl-3-pyrazolidinone.

Any of the light-sensitive sheet, the cover sheet and the alkali treating composition may contain development accelerators described on pages 72 to 91, hardening agents described on pages 146 to 155, surface active agents described on pages 201 to 210, fluorine-containing compounds described on pages 210 to 222, thickeners described on pages 225 to 227, antistatic agents described on pages 227 to 230, polymer latexes described on pages 230 to 239, matting agents described on page 240, which are described in JP-A-62-215272.

It is desirable that these alkali solution compositions are transferred to the photographic materials, with an extended thickness (an amount of the treating solution per $m^2$ after transfer of the treating solution) of from 20 to 200 μm.

When the photographic materials containing the compounds represented by formula (I) are processed, the processing temperature is preferably from 0° to 50° C., and more preferably from 0° to 40° C.

Further, in the present invention, by using the constituent elements such as the support, the layers, the compounds and the compositions described above, the color diffusion transfer photographic material comprising (a) the support and the image receiving sheet formed thereon comprising the neutralization layer, the neutralization timing layer, the image receiving layer and the separation layer in this order, (b) the support and the light-sensitive sheet formed thereon comprising at least one of silver halide emulsion layers combined with at least one of dye image forming compounds and (c) the alkali treating composition developed between the image receiving sheet and the light-sensitive sheet can be obtained. In this embodiment, the support may be transparent or opaque.

The present invention will be further illustrated in greater detail with reference to the following examples, which are, however, not to be construed as limiting the invention.

EXAMPLE 1

A transparent support formed of a polyethylene terephthalate film having a thickness of 150 μm was coated with the layers shown in Table 1 to prepare Photographic Material No. 101 for comparison.

TABLE 1

Constitution of Photographic Material No. 101 for Comparison

| Layer No. | Layer Name | Additive | Amount Applied ($g/m^2$) |
|---|---|---|---|
| 21st | Protective Layer | Gelatin | 1.00 |
| | | Matting Agent (1) | 0.25 |
| 20th | Ultraviolet Light Absorbing Layer | Gelatin | 0.50 |
| | | Ultraviolet Light Absorber (1) | $4.0 \times 10^{-4}$ |
| | | Ultraviolet Light Absorber (2) | $4.0 \times 10^{-4}$ |
| 19th | Yellow-Sensitive Layer (high sensitivity) | Internal Latent Image Type Direct Positive Emulsion (grain size: 1.7 μm, octahedral) | 0.60 (in terms of silver) |
| | | Sensitizing Dye (3) | $1.4 \times 10^{-3}$ |
| | | Nucleating Agent (1) | $6.8 \times 10^{-8}$ |
| | | Additive (2) | 0.03 |
| | | Gelatin | 0.70 |
| 18th | Yellow-Sensitive Layer (high sensitivity) | Internal Latent Image Type Direct Positive Emulsion (grain size: 1.1 μm, octahedral) | 0.25 (in terms of silver) |
| | | Sensitizing Dye (3) | $9.0 \times 10^{-4}$ |
| | | Nucleating Agent (1) | $8.0 \times 10^{-8}$ |
| | | Additive (2) | $4.5 \times 10^{-2}$ |
| | | Gelatin | 0.40 |
| 17th | White Reflective Layer | Titanium Dioxide | 0.70 |
| | | Gelatin | 0.18 |
| 16th | Yellow Color Material Layer | Yellow Dye Releasing Compound (1) | 0.53 |
| | | High Boiling Organic Solvent (1) | 0.13 |
| | | Additive (1) | $1.4 \times 10^{-2}$ |
| | | Gelatin | 0.70 |
| 15th | Intermediate Layer | Gelatin | 0.30 |
| 14th | Color Mixing Preventing Layer | Additive (1) | 0.80 |
| | | Polymethyl Methacrylate | 0.80 |
| | | Gelatin | 0.45 |
| 13th | Green-Sensitive Layer (high sensitivity) | Internal Latent Image Type Direct Positive Emulsion (grain size: 1.6 μm, octahedral) | 0.80 (in terms of silver) |
| | | Sensitizing Dye (2) | $2.1 \times 10^{-3}$ |
| | | Nucleating Agent (1) | $2.5 \times 10^{-8}$ |
| | | Additive (2) | 0.08 |

TABLE 1-continued

| | | | |
|---|---|---|---|
| | | Gelatin | 1.00 |
| 12th | Green-Sensitive Layer (high sensitivity) | Internal Latent Image Type Direct Positive Emulsion (grain size: 1.0 μm, octahedral) | 0.25 (in terms of silver) |
| | | Sensitizing Dye (2) | $1.1 \times 10^{-3}$ |
| | | Nucleating Agent (1) | $4.4 \times 10^{-8}$ |
| | | Additive (2) | 0.03 |
| | | Gelatin | 0.50 |
| 11th | White Reflective Layer | Titanium Dioxide | 1.00 |
| | | Gelatin | 0.25 |
| 10th | Magenta Color Material Layer | Magenta Dye Releasing Compound (1) | 0.50 |
| | | High Boiling Organic Solvent (1) | 0.10 |
| | | Additive (1) | $9.0 \times 10^{-3}$ |
| | | Gelatin | 0.90 |
| 9th | Intermediate Layer | Gelatin | 0.30 |
| 8th | Color Mixing Preventing Layer | Additive (1) | 1.20 |
| | | Polymethyl Methacrylate | 1.20 |
| | | Gelatin | 0.70 |
| 7th | Red-Sensitive Layer (high sensitivity) | Internal Latent Image Type Direct Positive Emulsion (grain size: 1.6 μm, octahedral) | 0.50 (in terms of silver) |
| | | Sensitizing Dye (1) | $6.2 \times 10^{-4}$ |
| | | Nucleating Agent (1) | $5.0 \times 10^{-8}$ |
| | | Additive (2) | 0.04 |
| | | Gelatin | 1.80 |
| 6th | Red-Sensitive Layer (high sensitivity) | Internal Latent Image Type Direct Positive Emulsion (grain size: 1.0 μm, octahedral) | 0.15 (in terms of silver) |
| | | Sensitizing Dye (1) | $3.0 \times 10^{-4}$ |
| | | Nucleating Agent (1) | $5.0 \times 10^{-8}$ |
| | | Additive (2) | 0.02 |
| | | Gelatin | 0.40 |
| 5th | White Reflective Layer | Titanium Dioxide | 3.00 |
| | | Gelatin | 0.80 |
| 4th | Cyan Color Material Layer | Cyan Dye Releasing Compound (1) | 0.50 |
| | | High Boiling Organic Solvent (1) | 0.10 |
| | | Additive (1) | 0.10 |
| | | Gelatin | 1.0 |
| 3rd | Opaque Layer | Carbon Black | 1.70 |
| | | Gelatin | 1.70 |
| 2nd | White Reflective Layer | Titanium Dioxide | 22.00 |
| | | Gelatin | 2.75 |
| 1st | Image Receiving Layer | Polymer Mordant (1) | 3.00 |
| | | Gelatin | 3.00 |
| | Support (polyethylene terephthalate, 150 μm) | | |

Polymer Mordant:

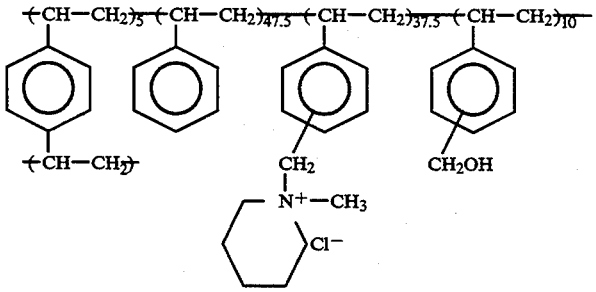

Ultraviolet Light Absorber (1):

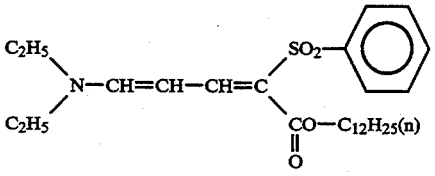

Ultraviolet Light Absorber (2):

TABLE 1-continued
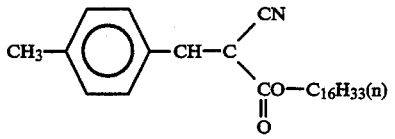
Matting Agent (1):
Spherical Latex of Polymethyl Methacrylate (average grain size: 4 μm)
Cyan Dye Releasing Compound (1):
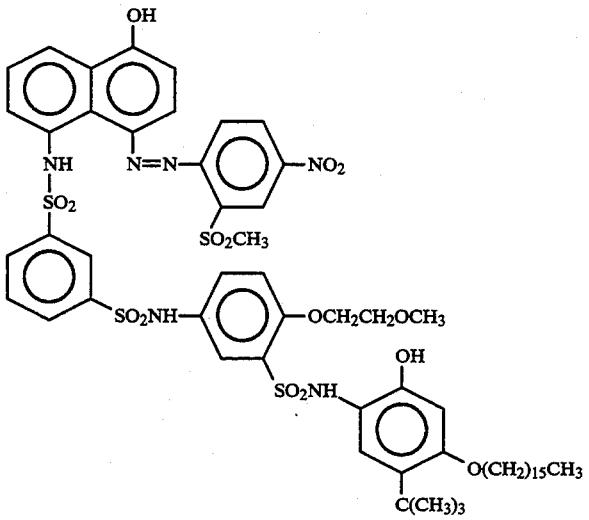
Magenta Dye Releasing Compound (1):
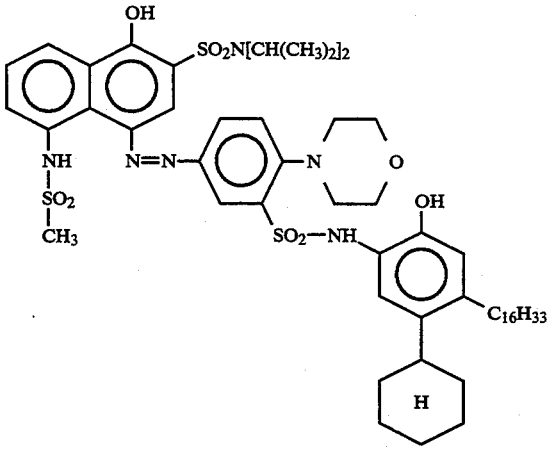
Yellow Dye Releasing Compound (1):
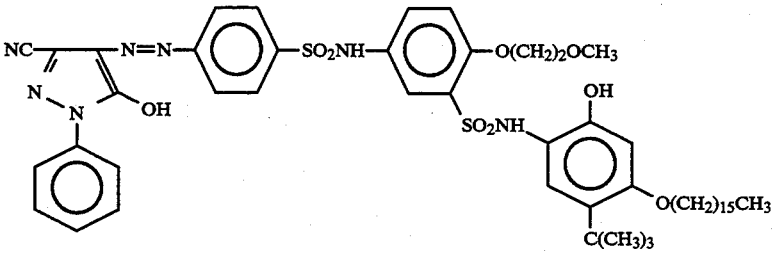
Additive (1):

TABLE 1-continued

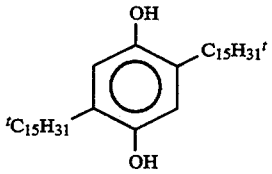

Additive (2):

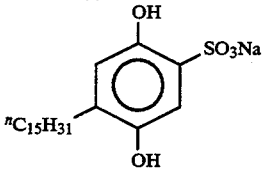

High Boiling Organic Solvent (1):
Tricyclohexyl Phosphate

Nucleating Agent (1):

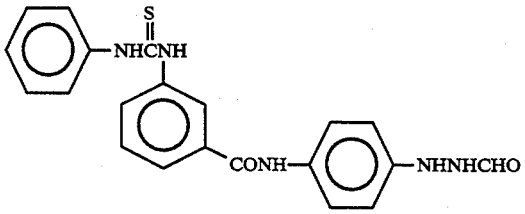

Sensitizing Dye (1):

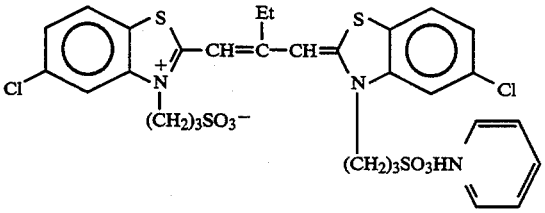

Sensitizing Dye (2):

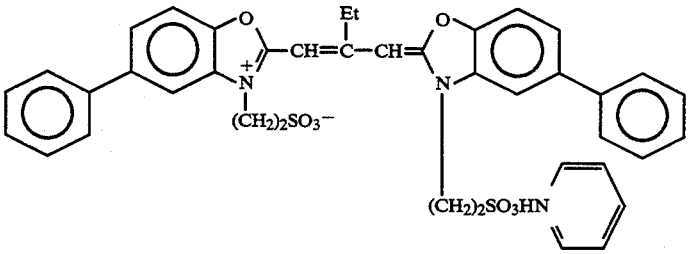

Sensitizing Dye (3):

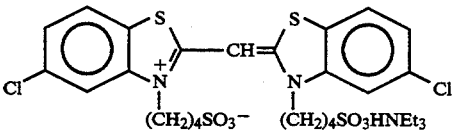

Photographic Material Nos. 102 to 114 were prepared in the same manner as with Photographic Material No. 101 with the exeption that the comparative compound or the compounds of the present invention shown in Table 2 described below were added to the 10th layers (the magenta color material layers) in the same mole amount as the magenta dye releasing compound.

A cover sheet was prepared in the following manner.

A transparent polyethylene terephthalate support having a gelatin undercoat and containing a light piping preventing dye was coated with the following layers:

(1) a neutralization layer containing 10.4 g/m$^2$ of an acrylic acid-butyl acrylate copolymer (molar ratio of 8:2) having an average molecular weight of 50,000 and 0.1 g/m$^2$ of 1,4-bis(2,3-epoxypropoxy)-butane, (2) a neutralization timing layer containing 4.3 g/m$^2$of acetylcellulose having an acetylation degree of 51% and 0.2 g/m$^2$ of poly(methyl vinyl ether-co-monomethyl-maleate), and (3) a layer containing a mixture (solid ratio of 6:4) of (a) a polymer latex obtained by emulsion polymerization of styrene/butyl acrylate/acrylic acid/N-methylolacrylamide in a weight ratio of 49.7/42.3/4/4 and (b) a polymer latex obtained by emulsion polymerization of methyl methacrylate/acrylic acid/N-methylolacrylamide in a weight ratio of 93/3/4 so as to give a total solid content of 1.0 g/m$^2$.

An alkali treating composition shown below was used:

| | |
|---|---|
| 1-p-Tolyl-4-hydroxymethyl-4-methyl-3-pyrazolidinone | 10.0 g |
| Methylhydroquinone | 0.18 g |
| 5-Methylbenzotriazole | 3.0 g |
| Sodium Nitrite (Anhydrous) | 0.2 g |
| Benzyl Alcohol | 1.5 ml |
| Carboxymethyl Cellulose Sodium Salt | 58 g |
| Carbon Black | 150 g |
| Potassium Hydroxide (28% Aqueous Solution) | 200 ml |
| Water | 680 ml |

Each "pressure-rupturable container" was filled with 0.8 g of the treating solution having the above-described composition.

After exposure from the emulsion layer side through a gray filter, the above-described photographic material was overlapped with the above-described cover sheet, and the above-described treating solution was developed between both materials to a thickness of 75 μm using a pressure roll at 25° C.

The photographic property was evaluated by the minimum density (Dmin) and the maximum density (Dmax) in magenta reflective density after an elapse of one day after processing. The measurement was carried out with a Fuji style densitometer (F.S.D. produced by Fuji Photo Film Co., Ltd.).

The results obtained are shown in Table 2 below.

TABLE 2

| Photographic Material No. | Added Compound | Magenta Reflective Density Dmin | Dmax | Remarks |
|---|---|---|---|---|
| 101 | — | 0.16 | 1.92 | Comparison |
| 102 | R-1*1) | 0.16 | 1.91 | Comparison |
| 103 | I-18 | 0.16 | 2.28 | Invention |
| 104 | I-1 | 0.16 | 2.40 | Invention |
| 105 | I-4 | 0.15 | 2.41 | Invention |
| 106 | I-2 | 0.15 | 2.30 | Invention |
| 107 | I-6 | 0.16 | 2.28 | Invention |
| 108 | I-3 | 0.16 | 2.31 | Invention |
| 109 | I-17 | 0.16 | 2.44 | Invention |
| 110 | I-10 | 0.16 | 2.43 | Invention |

TABLE 2-continued

| Photographic Material No. | Added Compound | Magenta Reflective Density Dmin | Dmax | Remarks |
|---|---|---|---|---|
| 111 | I-12 | 0.16 | 2.44 | Invention |
| 112 | I-16 | 0.16 | 2.51 | Invention |
| 113 | I-34 | 0.16 | 2.28 | Invention |
| 114 | I-35 | 0.16 | 2.28 | Invention |

*1)R-1: Compound (3) described in JP-B-4-13701 (corresponding to U.S. Pat. No. 4,590,154 and EP-B-160,313)

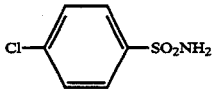

As is apparent from the results in Table 2, addition of the compounds of the present invention causes a remarkable increase in transfer density without an increase in Dmin.

For the compound described in JP-B-4-13701, the effect of increasing the transfer density as observed in the photographic material according to the present invention was not observed.

EXAMPLE 2

Photographic Material Nos. 201 to 210 were prepared in the same manner as with Example 1 with the exception that the comparative compound or the compounds of the present invention shown in Table 3 were added to the 4th cyan color material layers, the 10th magenta color material layers and the 16th yellow color material layers, respectively, in an amount of 100 mol % based on each of the dye releasing compounds.

Then, the photographic materials were processed similarly to Example 1 at temperatures of 5° C. or 25° C., and the maximum density (Dmax) of yellow, magenta and cyan was determined.

The results obtained are shown in Table 3 below.

TABLE 3

| Photographic Material No. | Added Compound | Dmax at 5° C. $D_B$ | $D_G$ | $D_R$ | Dmax at 25° C. $D_B$ | $D_G$ | $D_R$ | Remarks |
|---|---|---|---|---|---|---|---|---|
| 201 | — | 1.21 | 1.51 | 1.90 | 1.61 | 1.92 | 2.38 | Comparison |
| 202 | R-1 | 1.20 | 1.50 | 1.80 | 1.60 | 1.91 | 2.28 | Comparison |
| 203 | I-1 | 1.90 | 2.30 | 2.40 | 2.00 | 2.40 | 2.50 | Invention |
| 204 | I-4 | 1.92 | 2.31 | 2.39 | 2.02 | 2.41 | 2.49 | Invention |
| 205 | I-3 | 1.83 | 2.17 | 2.27 | 1.98 | 2.32 | 2.42 | Invention |
| 206 | I-2 | 1.88 | 2.12 | 2.32 | 2.00 | 2.34 | 2.44 | Invention |
| 207 | I-6 | 1.89 | 2.22 | 2.32 | 2.01 | 2.34 | 2.44 | Invention |
| 208 | I-10 | 1.96 | 2.37 | 2.44 | 2.04 | 2.45 | 2.52 | Invention |
| 209 | I-12 | 1.96 | 2.39 | 2.44 | 2.04 | 2.47 | 2.52 | Invention |
| 210 | I-16 | 2.06 | 2.47 | 2.51 | 2.12 | 2.52 | 2.56 | Invention |

*)R-1: The same as with Table 2

As is apparent from the results in Table 3, when the compounds of the present invention are used, not only the transfer density of each color increases, but also the treating temperature dependency (the difference between Dmax at 5° C. and Dmax at 25° C.) is significantly improved.

EXAMPLE 3

Photographic Material No. 301 for comparison having the following constitution:

Light-sensitive Element of Photographic Material No. 301:

A transparent polyethylene terephthalate support was coated with the following respective layers to prepare a light-sensitive sheet:

Backing layer: (a) a shading layer containing 4.0 g/m² of carbon black and 2.0 g/m² of gelatin;

Emulsion Layer Side:

(1) a layer containing 0.44 g/m² of the following cyan dye releasing redox compound, 0.09 g/m² of tricyclohexyl phosphate, 0.008 g/m² of 2,5-di-t-pentadecylhydroquinone and 0.8 g/m² of gelatin, (2) a layer containing 0.5 g/m² of gelatin, (3) a red-sensitive emulsion layer containing 0.6 g/m² (in terms of silver) of a red-sensitive internal latent image type direct positive silver bromide emulsion, 1.2 g/m² of gelatin, 0.015 g/m² of the following nucleating agent and 0.06 g/m² of 2-sulfo-5-n-pentadecylhydroquinone sodium salt,

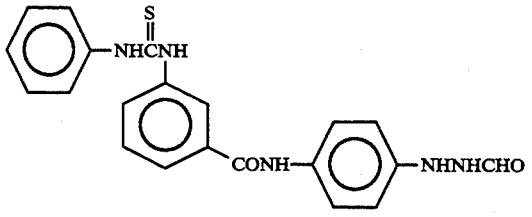

(4) a layer containing 0.43 g/m² of 2,5-di-t-pentadecylhydroquinone, 0.1 g/m² of trihexyl phosphate and 0.4 g/m² of gelatin, (5) a layer containing 0.3 g/m² of the following magenta dye releasing redox compound, 0.08 g/m² of tricyclohexyl phosphate, 0.009 g/m² of 2,5-di-t-pentadecylhydroquinone and 0.5 g/m² of gelatin,

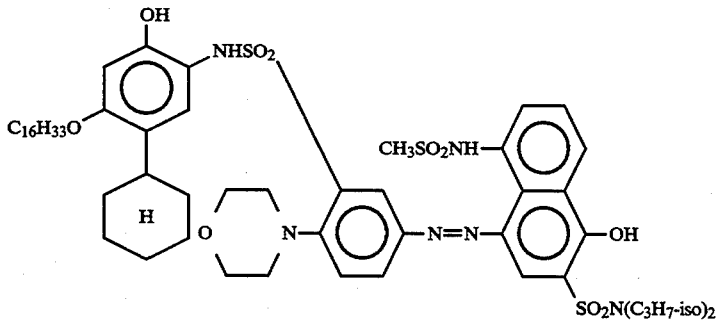

(6) a green-sensitive emulsion layer containing 0.42 g/m² (in terms of silver) of a green-sensitive internal latent image type direct positive silver bromide emulsion, 0.9 g/m² of gelatin, 0.013 g/m² of the same nucleating agent as in layer (3) and 0.07 g/m² of 2-sulfo-5-n-pentadecylhydroquinone sodium salt, (7) a layer which is the same as (4)

(8) a layer containing 0.53 g/m² of the following yellow dye releasing redox compound, 0.13 g/m² of tricyclohexyl phosphate, 0.014 g/m² of 2,5-di-t-pentadecylhydroquinone and 0.7 g/m² of gelatin,

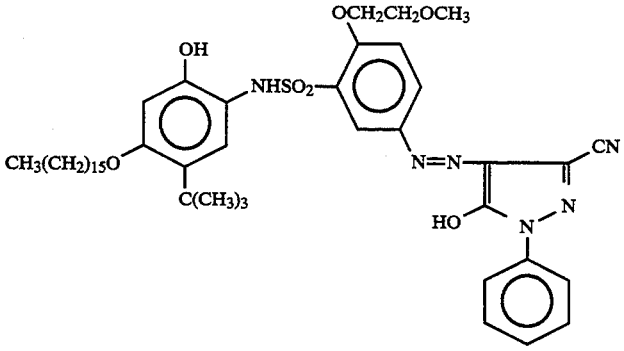

(9) a blue-sensitive emulsion layer containing 0.6 g/m² (in terms of silver) of a blue-sensitive internal latent image type direct positive silver bromide emulsion, 1.1 g/m² of gelatin, 0.019 g/m² of the same nucleating agent as in layer (3) and 0.05 g/m² of 2-sulfo-5-n-pentadecylhydroquinone sodium salt, and

(10) a layer containing 1.0 g/m² of gelatin.

Subsequently, Photographic Material Nos. 302 to 308 were prepared in the same manner as Photographic Material No. 301 with the exception that the comparative compound and the compounds of the present invention shown in Table 5 below were added to the layers containing the cyan, magenta and yellow dye releasing redox compounds, respectively, in an amount of 100 mol % based on each of the dye releasing compounds.

Dye Image Receiving Sheet:

An image receiving sheet having the layer constitution shown in Table 4 below was prepared:

TABLE 4

(Dye Fixing Element)

| Layer No. | Layer Name | Additive | Amount Applied (g/m²) |
|---|---|---|---|
| F6 | Protective Layer | Gelatin | 0.6 |
| F5 | Mordant Layer | Gelatin | 3.0 |
| | | Mordant (A) | 3.0 |

TABLE 4-continued

| | | | |
|---|---|---|---|
| F4 | Timing Layer (1) | Polymer Latex (1)(*) | 0.96 |
| | | Polymer Latex (2)(**) | 0.64 |
| F3 | Intermediate Layer | Poly-2-hydroxyethyl Methacrylate | 0.4 |
| F2 | Timing Layer (2) | Cellulose Acetate (acetylation degree: 51.3%) | 4.27 |
| | | Styrene/Maleic Anhydride (molar ratio: 1:1) Copolymer (average molecular weight: 10,000) | 0.23 |
| F1 | Neutralization Layer | Acrylic Acid/Butyl Acrylate (molar ratio: 8:2) Copolymer (average molecular weight: 50,000) | 22 |
| | Paper Support (150 μm, laminated with 30 μm-thick polyethylene films on both sides) | | |
| B1 | Shading Layer | Gelatin | 2.0 |
| | | Carbon Black | 4.0 |
| B2 | White Layer | Gelatin | 1.0 |
| | | Titanium Oxide | 8.0 |
| B3 | Protective Layer | Gelatin | 0.6 |

(*)(emulsion polymerization latex of styrene/butyl acrylate/acrylic acid/N-methylol acrylamide (49.7/42.3/4/4 by weight))
(**)(emulsion polymerization latex of methyl methacrylate/acrylic acid/N-methylol acrylamide (93/3/4 by weight))
Coating Aid (B):

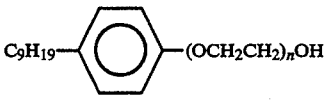

(n = 30)

Mordant (A):

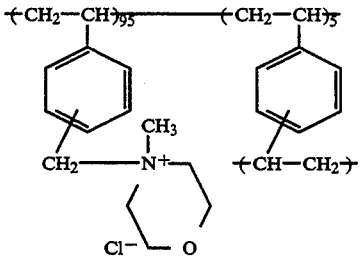

Treating Solution

| | |
|---|---|
| 1-p-Tolyl-4-hydroxymethyl-4-methyl-3-pyrazolidinone | 6.9 g |
| Methylhydroquinone | 0.3 g |
| 5-Methylbenzotriazole | 3.5 g |
| Sodium Nitrite (Anhydrous) | 0.2 g |
| Carboxymethyl Cellulose Sodium Salt | 58 g |
| Potassium Hydroxide (28% Aqueous Solution) | 200 ml |
| Benzyl Alcohol | 1.5 ml |
| Water | 835 ml |

Then, after imagewise exposure to the light-sensitive sheet, each of the light-sensitive sheets was superposed on the image receiving sheet, and the above-described treating solution was developed between both the sheets to a thickness of 60 μm at 25° C. When the light-sensitive sheet was separated from the image receiving sheet 90 seconds after processing, the maximum density (Dmax) was examined.

The results obtained are shown in Table 5 below.

TABLE 5

| Photographic Material No. | Added Compound | Dmax $D_B$ | $D_G$ | $D_R$ | Remarks |
|---|---|---|---|---|---|
| 301 | — | 1.44 | 1.76 | 2.16 | Comparison |
| 302 | I-4 | 1.80 | 2.20 | 2.68 | Invention |
| 303 | I-2 | 1.70 | 2.10 | 2.60 | Invention |

TABLE 5-continued

| Photographic Material No. | Added Compound | Dmax $D_B$ | $D_G$ | $D_R$ | Remarks |
|---|---|---|---|---|---|
| 304 | I-10 | 1.81 | 2.21 | 2.72 | Invention |
| 305 | I-12 | 1.82 | 2.22 | 2.72 | Invention |
| 306 | I-14 | 1.84 | 2.31 | 2.74 | Invention |
| 307 | I-16 | 1.84 | 2.32 | 2.74 | Invention |
| 308 | I-40 | 1.82 | 2.30 | 2.72 | Invention |

As is apparent from the results in Table 5, a remarkable increase in transfer density was observed when the compounds of the present invention were used.

In the system of treating the light-sensitive elements containing the compounds represented by formula (I) with the alkali treating compositions, the transfer density (Dmax) and the treating temperature dependency thereof on color diffusion transfer are improved.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material comprising a color diffusion transfer light-sensitive element containing at least one of compounds represented by the following formula (I) and an alkali treating composition:

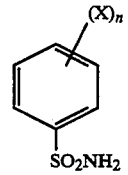

(I)

wherein the substituent represented by X is selected from the group consisting of a substituted or unsubstituted alkyl group, a substituted or unsubstituted alkoxy group, a substituted or unsubstituted alkoxycarbonyl group, a substituted or unsubstituted acylamino group, a substituted or unsubstituted urethane group and a substituted or unsubstituted amino group;

n represents an integer of 1 to 5;

the substituents represented by X are the same or different, when n is 2, 3, 4 or 5;

two substituents represented by X may be combined with each other to form a saturated ring or an unsaturated ring, when n is 2, 3, 4 or 5; and the substituents represented by X may further be substituted by substituents represented by X, wherein said light-sensitive element comprises:

(a) a transparent support and a light-sensitive sheet formed thereon comprising an image receiving layer, a white reflective layer, a shading layer and at least one silver halide emulsion layer combined with at least one dye image forming compound;

(b) a transparent support and a transparent cover sheet formed thereon comprising at least a neutralization layer and a neutralization timing layer; and (c) a shading alkali treating composition developed between the light-sensitive sheet and the transparent cover sheet.

2. The color diffusion transfer photographic material as claimed in claim 1, wherein the substituent represented by X is selected from the group consisting of a substituted or unsubstituted acylamino group, a substituted or unsubstituted urethane group and a substituted or unsubstituted amino group.

3. A color diffusion transfer photographic material comprising a color diffusion transfer light-sensitive element containing at least one of compounds represented by the following formula (I) and an alkali treating composition:

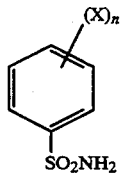

(I)

wherein the substituent represented by X is selected from the group consisting of a substituted or unsubstituted alkyl group, a substituted or unsubstituted alkoxy group, a substituted or unsubstituted alkoxycarbonyl group, a substituted or unsubstituted acylamino group, a substituted or unsubstituted urethane group and a substituted or unsubstituted amino group;

n represents an integer of 1 to 5;

the substituents represented by X are the same or different, when n is 2, 3, 4 or 5;

two substituents represented by X may be combined with each other to form a saturated ring or an unsaturated ring, when n is 2, 3, 4 or 5; and the substituents represented by X may further be substituted by substituents represented by X, wherein said light sensitive element comprises:

(a) a support and an image receiving sheet formed thereon comprising a neutralization layer, a neutralization timing layer, an image receiving layer and a separation layer in this order;

(b) a support and a light-sensitive sheet formed thereon comprising at least one silver halide emulsion layer combined with at least one dye image forming compound; and (c) the alkali treating composition developed between the image receiving sheet and the light-sensitive sheet.

* * * * *